US009580155B2

(12) United States Patent
Lake et al.

(10) Patent No.: US 9,580,155 B2
(45) Date of Patent: Feb. 28, 2017

(54) APPARATUS FOR TOWING A WATER SPORTS PERFORMER

(71) Applicants: MasterCraft Boat Company, LLC, Vonore, TN (US); Gere Marie Corporation, Lake Zurich, IL (US)

(72) Inventors: Ryan D. Lake, Lenoir City, TN (US); Chadrick E. Curts, Madisonville, TN (US); James G. Schultz, Lake Zurich, IL (US); Cory J. Peltzer, Lake Zurich, IL (US); Gregory A. Mackall, Wauconda, IL (US)

(73) Assignees: MASTERCRAFT BOAT COMPANY, LLC, Vonore, TN (US); GERE MARIE CORPORATION, Lake Zurich, IL (US)

( * ) Notice: Subject to any disclaimer, the term of this patent is extended or adjusted under 35 U.S.C. 154(b) by 184 days.

(21) Appl. No.: 14/319,078

(22) Filed: Jun. 30, 2014

(65) Prior Publication Data

US 2015/0375835 A1 Dec. 31, 2015

(51) Int. Cl.

| | |
|---|---|
| ***B63B 35/81*** | (2006.01) |
| ***B63B 17/00*** | (2006.01) |
| ***B63B 15/00*** | (2006.01) |

(52) U.S. Cl.

CPC ..... *B63B 35/816* (2013.01); *B63B 15/00* (2013.01); *B63B 17/00* (2013.01); *B63B 35/815* (2013.01)

(58) Field of Classification Search

CPC ..... B63B 17/00; B63B 17/02; B63B 17/04; B63B 21/56; B63B 35/815; B63B 35/816

USPC ..... 114/253, 343, 364

See application file for complete search history.

(56) References Cited

U.S. PATENT DOCUMENTS

| | | | | |
|---|---|---|---|---|
| 5,052,326 | A | 10/1991 | Wiggen et al. | |
| 5,673,507 | A | 10/1997 | Stokes, Jr. | |
| 6,044,788 | A | 4/2000 | Larson et al. | |
| 6,151,756 | A * | 11/2000 | Czipri | B63B 17/02 16/361 |
| 6,192,819 | B1 | 2/2001 | Larson et al. | |
| 6,374,762 | B1 | 4/2002 | Larson et al. | |
| RE37,823 | E | 9/2002 | Larson et al. | |
| 6,666,159 | B2 | 12/2003 | Larson et al. | |
| 6,792,888 | B1 | 9/2004 | Metcalf | |
| 6,854,413 | B2 | 2/2005 | Jackson et al. | |
| 6,865,999 | B2 * | 3/2005 | Bierbower, Jr. | B63B 15/00 114/253 |
| 6,986,321 | B2 | 1/2006 | Metcalf | |
| 6,997,131 | B2 | 2/2006 | Jackson et al. | |

(Continued)

*Primary Examiner* — Ajay Vasudeva

(74) *Attorney, Agent, or Firm* — Fitzpatrick, Cella, Harper & Scinto

(57) ABSTRACT

An apparatus for towing a water sports performer includes a first mounting plate, a second mounting plate, and a tower. The first mounting plate is adapted for attachment to a port gunwale of a boat. The second mounting plate is adapted for attachment to a starboard gunwale of the boat. The tower is pivotably and detachably secured to the first and second mounting plates. Each of the first and second mounting plates includes a retractable tower connector that, when retracted, is positioned at or below a substantially flat upper surface of the mounting plate, and, when not retracted, extends above the upper surface of the mounting plate to pivotably and detachably secure the tower to the mounting plate.

20 Claims, 6 Drawing Sheets

(56) References Cited

U.S. PATENT DOCUMENTS

| | | | | |
|---|---|---|---|---|
| 7,162,968 | B2 * | 1/2007 | Thompson | B63B 17/02 114/361 |
| 7,219,617 | B2 * | 5/2007 | Metcalf | B63B 15/00 114/253 |
| 7,334,956 | B2 | 2/2008 | Taylor | |
| 7,392,758 | B2 | 7/2008 | Metcalf | |
| 7,536,971 | B1 | 5/2009 | Fry | |
| 8,166,905 | B2 * | 5/2012 | Gratsch | B63B 17/00 114/364 |
| 8,171,874 | B2 * | 5/2012 | Gasper | B63B 35/815 114/253 |
| 8,196,542 | B2 * | 6/2012 | Oswell | B63B 35/816 114/343 |
| 8,205,571 | B1 | 6/2012 | Rondeau et al. | |
| 8,485,119 | B2 | 7/2013 | Gasper | |
| 8,495,967 | B2 | 7/2013 | Williams et al. | |
| 8,522,706 | B2 * | 9/2013 | Larson | B63B 15/00 114/125 |
| 8,555,802 | B2 | 10/2013 | Oswell et al. | |
| 9,061,748 | B2 | 6/2015 | Metcalf | |
| 9,114,854 | B2 | 8/2015 | Williams et al. | |
| 9,114,855 | B2 | 8/2015 | Nemeth | |
| 2013/0340664 | A1 | 12/2013 | Larson et al. | |
| 2014/0048007 | A1 | 2/2014 | Williams et al. | |
| 2014/0190392 | A1 | 7/2014 | Williams et al. | |

* cited by examiner

APPARATUS FOR TOWING A WATER SPORTS PERFORMER

FIELD OF THE INVENTION

This invention relates to an apparatus for towing a water sports performer from behind a boat, as well as a boat equipped with such an apparatus.

BACKGROUND OF THE INVENTION

Boats are used to tow water sports performers, such as water skiers, wakeboarders, and the like, using a tow-line. The performer holds onto one end of the tow-line and the other end is attached to the boat. For water skiing, the tow-line is typically attached to a ski pylon within the boat, often somewhere in or near the center of the boat. For wakeboarding, the tow-line is typically attached to the top of a tower, which provides a higher tow-line attachment point than a pylon provides. The tower legs usually are attached to the port and starboard gunwales of the boat. To maximize a boat's versatility, it is desirable to have both a ski pylon for water skiing and a tower for wakeboarding. But a problem with having both is that the tower legs can interfere with a tow line attached to the ski pylon, particularly when a water skier swings out to a side of the boat.

SUMMARY OF THE INVENTION

In one aspect, the invention relates to an apparatus for towing a water sports performer. The towing apparatus includes a first mounting plate, a second mounting plate, and a tower. The first and second mounting plates are adapted for attachment to port and starboard gunwales of a boat, respectively. The tower includes a tow-line attachment structure at an upper portion thereof and is pivotably and detachably secured to the first and second mounting plates by a retractable tower connecter. Each of the first and second mounting plates includes a retractable tower connector that, when retracted, is positioned at or below a substantially flat upper surface of the mounting plate, and, when not retracted, extends above the upper surface of the mounting plate to pivotably and detachably secure the tower to the mounting plate.

Each tower connector may be retracted by detaching the tower and rotating the tower connector about an axis, preferably one that is substantially perpendicular or substantially parallel to an axis about which the tower is pivotable.

Preferably, each tower connector includes a hook that is engagable with the tower, and each tower connector is retracted by detaching the tower and rotating the tower connector about an axis that is substantially perpendicular to the axis about which the tower is pivotable. When each tower connector is retracted, a side of the hook is substantially flush with the upper surface of the mounting plate. Each tower connector may also include a latch for keeping the tower engaged with the hook. The tower connecter preferably includes a spring and the latch is movable against a bias imparted by the spring in order to detach the tower from the hook.

The towing apparatus may also include a first locking mechanism and a second locking mechanism. The first locking mechanism locks the tower to the first mounting plate and the second locking mechanism locks the tower to the second mounting plate. Each of the first and second locking mechanisms is preferably a bolt that is insertable through a foot of the tower and is engagable with a threaded recess in a respective one of the first and second mounting plates.

Instead of a hook, each tower connector may include a pin that is engagable with the tower. In this case, it may be desirable to have the pin be rotatable about an axis that is substantially parallel to the axis about which the tower is pivotable.

In another aspect, the invention relates to a boat. The boat includes a hull including a bow, a stern, and starboard and port sides. The boat also includes a towing apparatus, such as described herein, for towing a water sports performer. The towing apparatus is attached to the port and starboard gunwales of the boat.

DETAILED DESCRIPTION OF THE PREFERRED EMBODIMENTS

Figure 1:
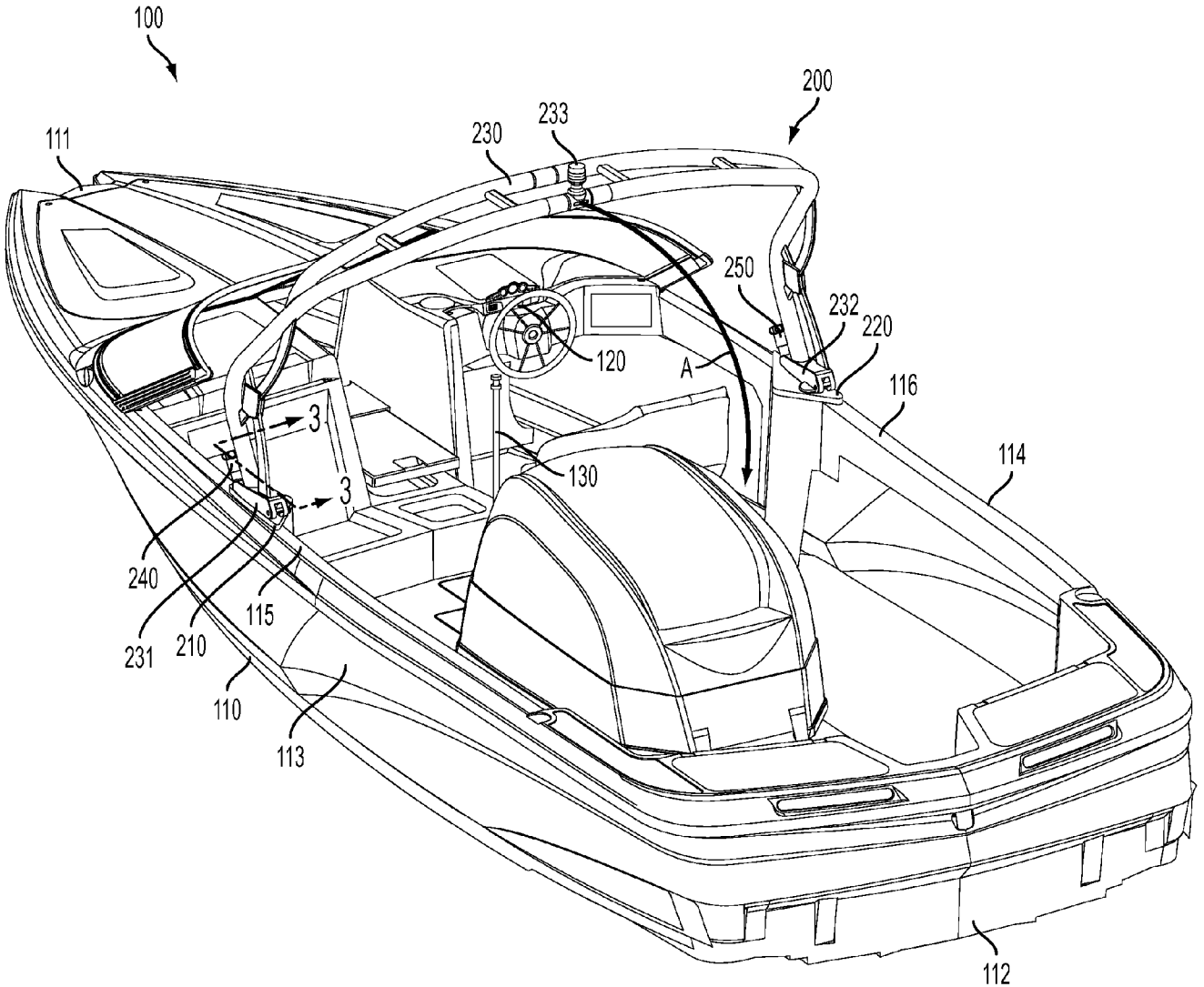
FIG. 1 shows a boat including an apparatus for towing a water sports performer according to a first preferred embodiment of the invention.

FIG. 1 shows a boat 100 equipped with an apparatus 200 for towing a water sports performer in accordance with a first exemplary preferred embodiment of the invention. The apparatus 200 is particularly suited for towing a wakeboarder. The boat 100 includes a hull 110 with a bow 111, a stern 112, and port and starboard sides 113, 114. The port and starboard sides 113, 114 have port and starboard gunwales 115, 116, respectively. Within the boat's interior is a control console 120 for operating the boat 100 and a ski pylon 130 for towing a water sports performer such as a water skier.

The towing apparatus 200 includes first and second mounting plates 210, 220 and a tower 230. The first mounting plate 210 is attached to the port gunwale 115, and the second mounting plate 220 is attached to the starboard gunwale 116. In this embodiment, each mounting plate 210, 220 contains countersunk bores through which a bolt may be inserted. The bolt engages with threads embedded in (or below) the port or starboard gunwales 115, 116 to attach the mounting plate 210, 220 to the gunwales 115, 116. The bolts preferably are made from stainless steel and the mounting plates 210, 220 preferably are made from aluminum. To prevent the aluminum from damaging the gloss coat of the fiberglass gunwales, a thin piece of plastic (approximately ¼ inch) may be placed between each of the mounting plates 210, 220 and the gunwales 115, 116. The bolts preferably are countersunk to maintain a substantially flat upper surface 211, 221 of each mounting plate 210, 220, as will be discussed further below. However, any suitable means for attaching the mounting plates 210, 220 to the gunwales 115, 116 may be used, including but not limited to welds, rivets, and epoxy.

The tower 230 has two feet, a first foot 231 where the tower is pivotably and detachably secured to the first mounting plate 210, and a second foot 232 where the tower is pivotably and detachably secured to the second mounting plate 220. The tower 230 also has a tow-line attachment structure 233 at an upper portion of the tower 230. This tow-line attachment structure 233 may be used to connect a tow-line suitable for towing a water sports performer, such as a wakeboarder, to the boat. Any suitable tow-line attachment structure may be used, including but not limited to the integrated light and tow-line-attachment assembly disclosed in U.S. Pat. No. 6,539,886, the disclosure of which is incorporated herein in its entirety.

Figure 2:
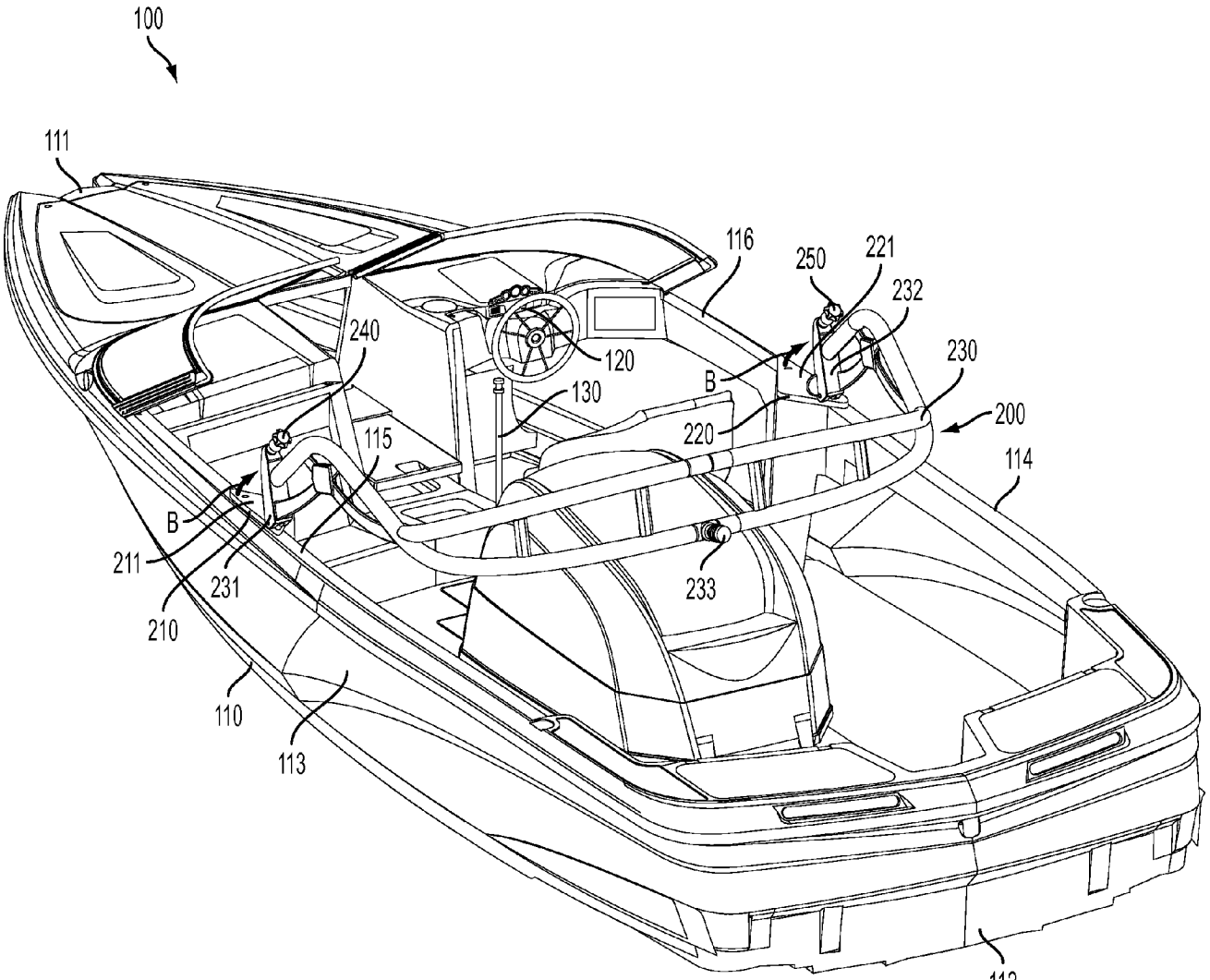
FIG. 2 shows the boat of FIG. 1 with the towing apparatus in a rotated position.

Some water sports performers, such as wakeboarders, desire the tow-line to be attached high on the boat to enable higher tricks. Towers are thus suitably used as attachment points for the tow-line. Because of its height, the tower may interfere with transportation, storage, and the like, when in an upright position as shown in FIG. 1. Therefore, in this embodiment, the tower 230 is rotatable down and aft in direction A to reduce the height of the tower 230. FIG. 2 shows the tower in the rotated position. As the tower rotates in direction A, a front portion of each foot 231, 232 rotates up and aft in direction B. Instead of rotating down and aft, the towing apparatus could easily be configured so that the tower rotates down and forward.

Other water sports performers, such as water skiers, desire the tow-line to be attached to the boat at about shoulder height. The tow-line for water skiing preferably is attached to a ski pylon 130 located in or near the center of the boat. Since the tower used for towing wakeboarders can interfere with towing a water skier using the ski pylon 130, the tower 230 preferably is easily detachable. That way, the boat 100 can quickly and easily go from being used from wakeboarding to being used for water skiing, and vice versa. Another advantage of having an easily detachable tower is that once the tower is removed, the weight of the boat is decreased, which is desirable for water skiing. The tower 230 preferably is made from aluminum because it has good corrosion resistance, provides suitable strength for towing a water sports performer, and is lightweight enough to allow a person to rotate and detach the tower 230 easily.

Figure 3:
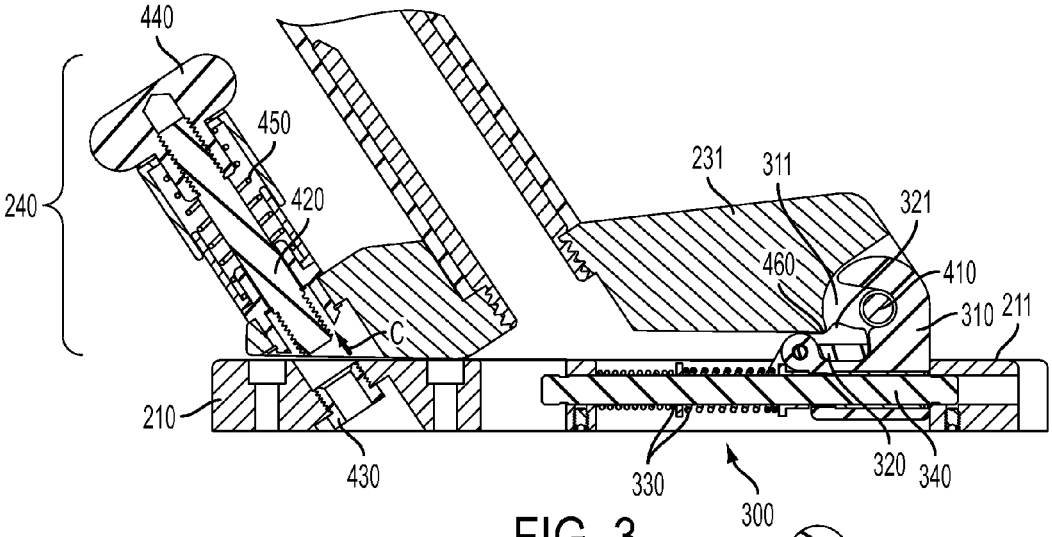
FIG. 3 is a cross-sectional view taken along line 3-3 of the port mounting plate and port tower foot of the towing apparatus shown in FIG. 1.

Further details regarding how the tower 230 is rotated and detached will now be described with reference to FIGS. 3-5. While the following description describes the first mounting plate 210, the first foot 231 of the tower 230, and a first locking mechanism 240, the description applies equally to the second mounting plate 220, the second foot 232 of the tower 230, and a second locking mechanism 250.

The first mounting plate 210 includes a retractable tower connecter 300 that pivotably and detachably secures the tower 230 to the first mounting plate 210. In this embodiment the retractable tower connecter 300 includes a hook 310. The hook 310 extends above the substantially flat upper surface 211 of the first mounting plate 210 and engages with a pin 410. The pin 410 is attached to the first foot 231 and forms the pivot axis about which the tower rotates between the upright position and the rotated position. The pivot axis should be above the substantially flat upper surface 211 of the first mounting plate 210 to allow the tower 230 to rotate.

In the upright position, the tower 230 is also secured to the first mounting plate 210 by the first locking mechanism 240. In this embodiment, the first locking mechanism 240 includes a bolt 420 that is inserted through the first foot 231 and engages with a threaded recess 430 in the first mounting plate 210. To pivot or detach the tower 230, a user unscrews the bolt 420 using a handle 440 attached to the end of the bolt 420. Once the bolt 420 is disengaged from the threaded recess 430, a spring 450 biases the bolt 420 in direction C, holding the bolt 420 in an up position and preventing the bolt 420 from interfering with detaching or rotating the tower 230.

Figure 4:
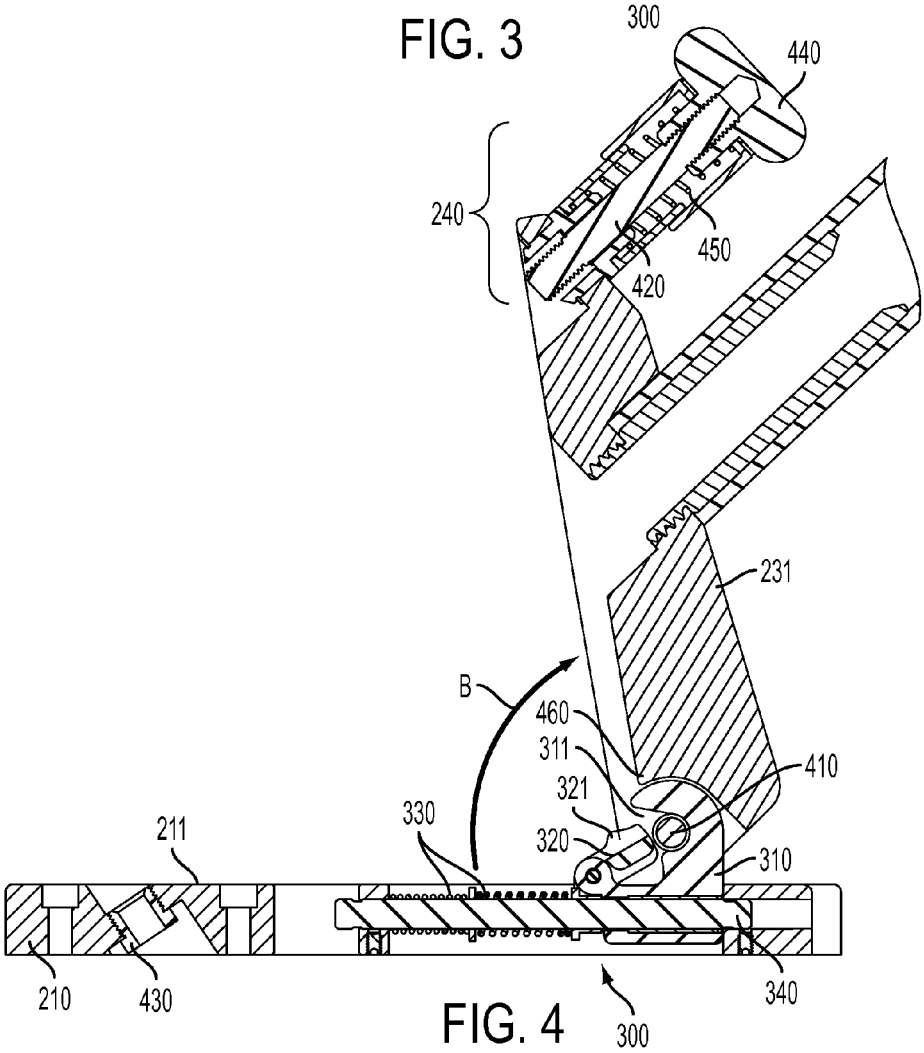
FIG. 4 is the cross-section of FIG. 3 with the towing apparatus in the rotated position.
Figure 5:
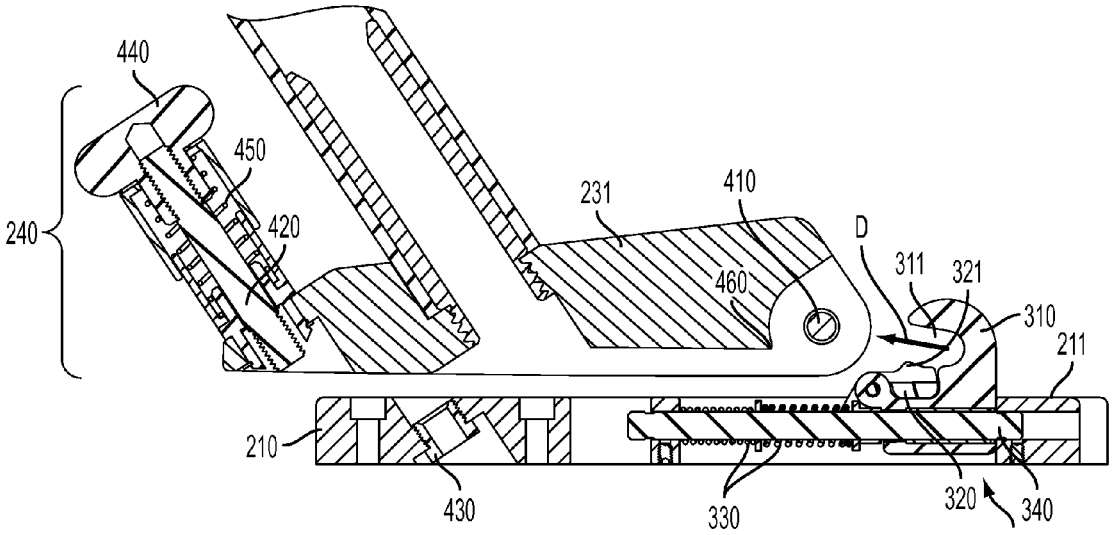
FIG. 5 is the cross-section of FIG. 3 with the tower detached from the mounting plate.

FIG. 4 shows the tower 230 in the rotated position. As discussed above, the foot 231 rotates about pin 410 in direction B to move from the upright position to the rotated position. Because the rotated position is generally used for transportation and storage, the tower 230 is preferably secured to the mounting plate in this position. To prevent the pin 410 from becoming disengaged from the hook 310, the retractable tower connecter includes a latch 320. The latch 320 covers a portion of the throat 311 of the hook 310 to prevent the pin 410 from sliding out of the hook 310 in the rotated position. A spring force imparted by two compression springs 330 is used to bias the latch 320 in a direction to close the portion of the throat 311.

To detach the tower 230 from the boat 100, the tower 230 should be in its upright position and the bolt 420 should be in its up position, disengaged from the threaded recess 430. In the upright position shown in FIG. 3, a latch contact portion 460 of the first foot 231 holds the latch 320 down, opening the throat 311. A user can then slide the tower 230, and in particular the foot 231, forward in direction D, as shown in FIG. 5. The pin 410 disengages from the hook 310 and the tower 230 is detached from the first mounting plate 210. To prevent the pin 410 from disengaging too easily, such as when the tower is rotated from the rotated position to the upright position, a raised portion (or hump) 321 is provided on the latch 320. The raised portion 321 is sized to provide resistance for the pin 410 but not prevent the pin 410 from passing through the throat 311. Force provided by a user is thus required to push the pin 410 past the raised portion 321 and out of the hook 310.

In some instances when towing a water skier, the water skier will move forward, alongside the boat, for example, when the water skier performs a ski jump. The tow-line moves with the water skier to be perpendicular to the boat or even forward of the ski pylon. With the tower 230 detached, the tow-line is free to move to this position. As the skier and the tow-line move from alongside the boat to behind the boat, it is important that the tow-line not be snagged on any surface. The height of the mounting plates 210, 220 is thus minimized and each has a substantially flat upper surface 211, 221. For the same reason, the bolts attaching the mounting plates 210, 220 to the gunwales are countersunk and the threaded recess 430 is recessed into its respective mounting plate 210, 220. The retractable tower connecter 300 may be retracted to a position at or below the substantially flat upper surface 211, 221 to prevent the tow-line from snagging on the retractable tower connector 300, specifically in this embodiment, the hook 310. To further the possibility of the tow-line being snagged on the mounting plates, the mounting plates may be provided with beveled or chamfered edges, or they may be countersunk within the gunwales.

Figure 6:
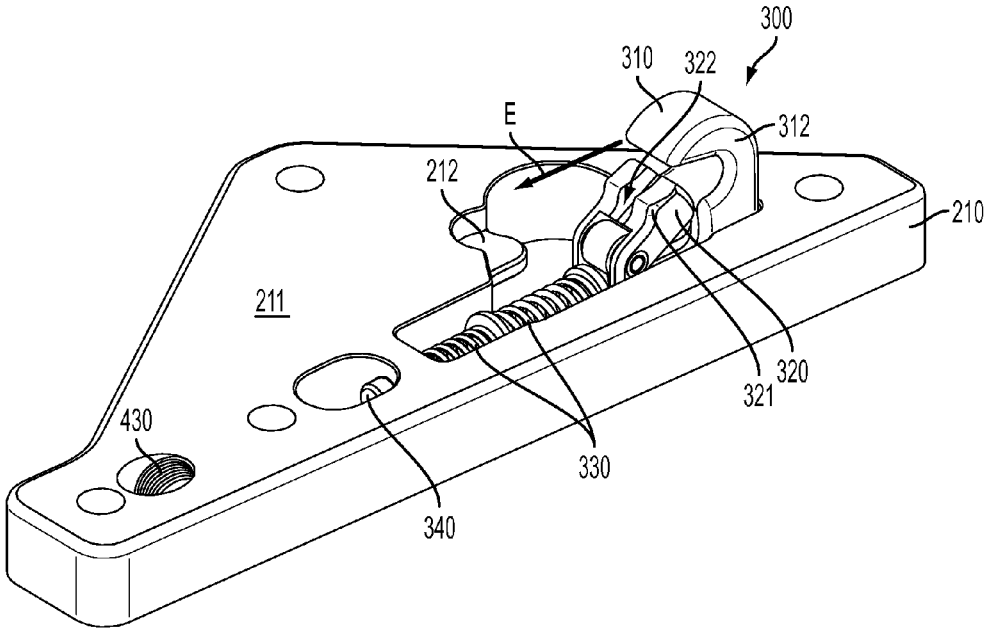
FIG. 6 is a perspective view of the port mounting plate of the towing apparatus shown in FIG. 1.
Figure 7:
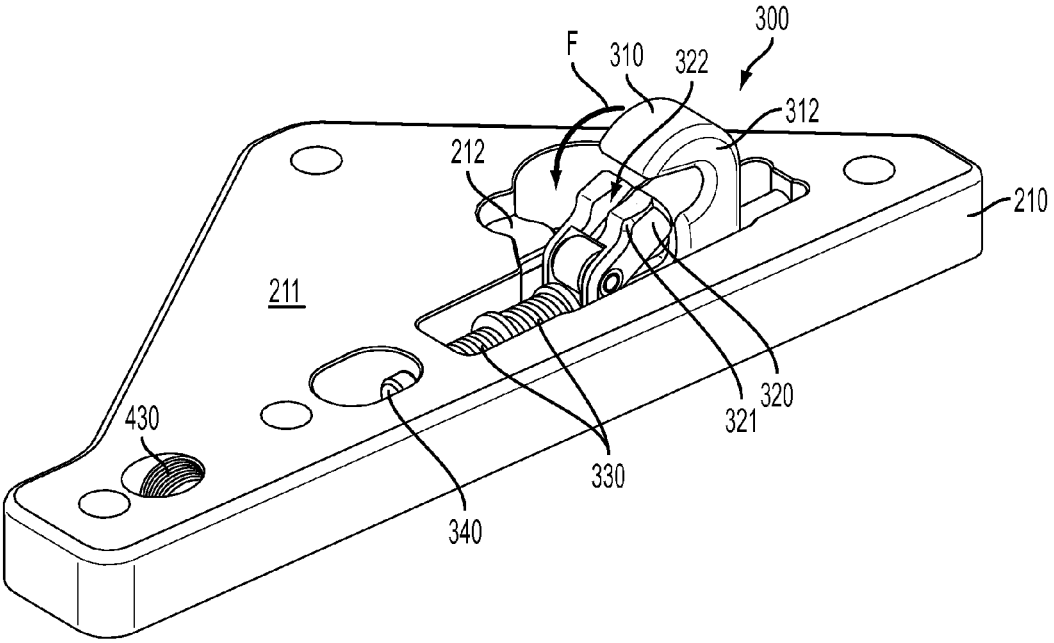
FIG. 7 is a perspective view of the port mounting plate shown in FIG. 6 with a retractable tower connector in the process of being retracted.
Figure 8:
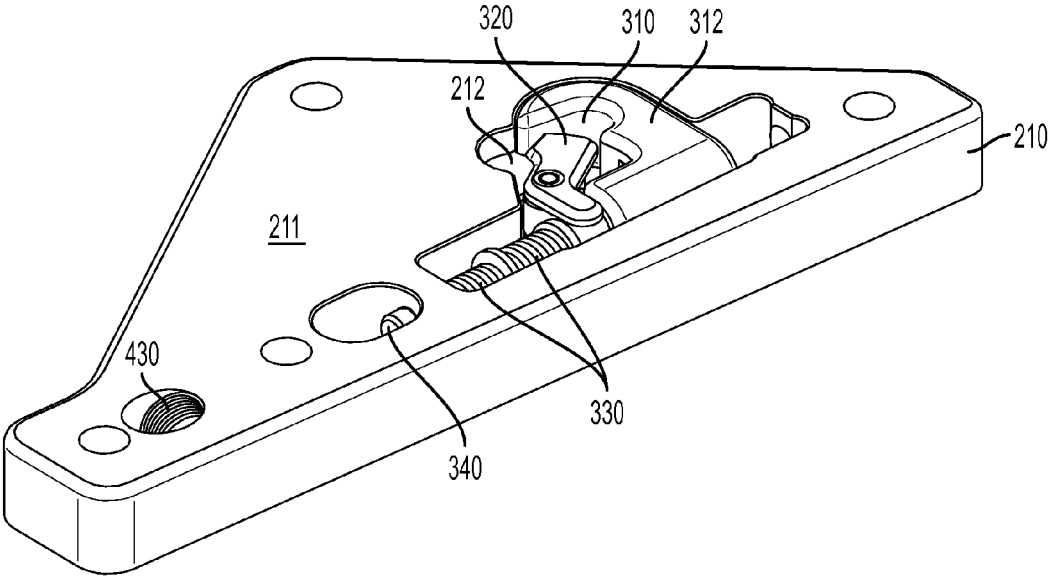
FIG. 8 is a perspective view of the port mounting plate shown in FIG. 6 with the retractable tower connector fully retracted.

The process of retracting the retractable tower connecter 300 will now be described with reference to FIGS. 6-8. As with the description of rotating and detaching the tower 230, the following description describes the first mounting plate 210, but the description applies equally to the second mounting plate 220.

In this embodiment, the hook 310 and latch 320 are attached about a shaft 340. To retract the retractable tower connecter 300, the hook 310 and latch 320 are pushed forward in direction E against a spring force of the compression springs 330 that are disposed around the shaft 340 forward of the hook 310 and latch 320. When the hook 310 and latch 320 reach an intermediate position, they may be rotated about the shaft 340 in direction F. The hook 310 and latch 320 are rotated into a recess in the first mounting plate 210. The recess and mounting plate are sized such that an outboard side 312 of the hook is substantially flush with the upper surface of the first mounting plate 210 when the retractable tower connecter 300 is retracted.

In this embodiment the retractable tower connecter 300 is held in the retracted position by a groove 322 in the latch 320. The groove 322 engages with a portion 212 of the first mounting plate 210 and the spring force from the compression springs 330 keeps the groove 322 and the portion 212 of the first mounting plate 210 engaged. Those skilled in the art will recognize that other suitable retraction methods may be used. These methods include rotating the hook 310 forward or back. The retractable tower connection 300 of this embodiment preferably retracts by rotating in direction F which is substantially perpendicular to the pivot axis of the tower 230. This rotation is preferable because it minimizes the height of the first mounting plate 210. In order to provide the strength necessary to tow a water sports performer, the hook, which is made from aluminum, is about 1 inch wide and about 2 inches from front to back. The first mounting plate 210 would need to be about 2 inches thick in order to allow the hook 310 to retract if it retracted by pivoting in the same direction as the tower 230. Alternatively, a cavity could be created in the gunwale 115 to allow the retractable tower connecter 300 to retract and maintain a low profile for the mounting plates 210, 220. The cavity, however, would weaken the strength of the gunwale, and therefore this alternative configuration is less preferred than the embodiment shown, though still within the scope of the invention.

Figure 9:
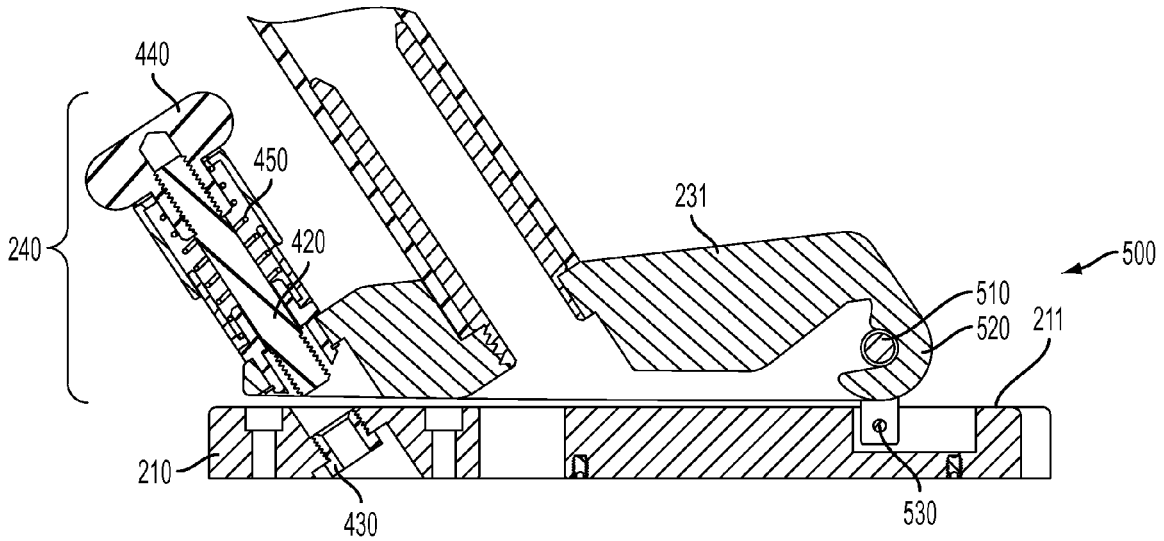
FIG. 9 is a cross-sectional view of a port mounting plate and port tower foot of a towing apparatus according to a second preferred embodiment of the invention.
Figure 10:
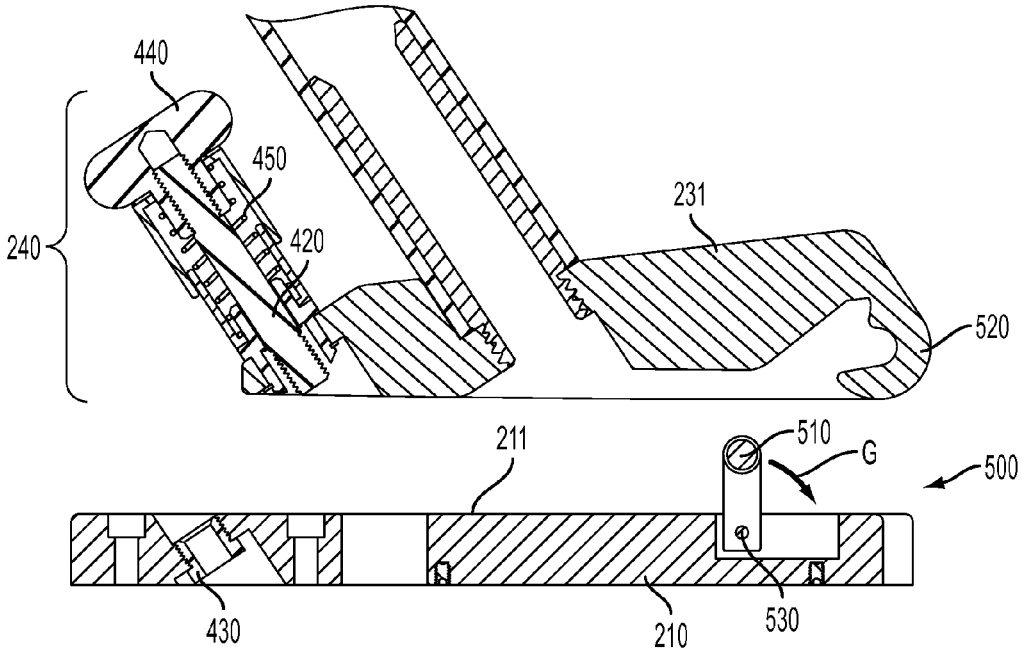
FIG. 10 is the cross-section of FIG. 9 with the tower detached from the mounting plate.

Other suitable retractable tower connectors may be used without deviating from the scope of the invention. One such alternate retractable tower connecter 500 is shown in FIGS. 9 and 10. The towing apparatus with this alternate retractable tower connecter 500 operates similarly to the apparatus previously discussed. But here, the retractable tower connecter 500 includes a pin 510 within the mounting plate 210 that is engagable with a hook 520 on the foot 231 of the tower 230. This alternate retractable tower connecter 500 retracts by pivoting about another pin 530 in direction G after the tower is detached.

While the forgoing discussion references certain materials, those skilled in the art will recognize that any material suitable for use in a marine environment and having other suitable characteristics for performing the functions discuss above (for example, strength and wear resistance) may be used in this invention.

The embodiments discussed herein are examples of preferred embodiments of the present invention and are provided for illustrative purposes only. They are not intended to limit the scope of the invention. Although specific configurations, structures, materials, etc. have been shown and described, such are not limiting. Modifications and variations are contemplated within the scope of the invention, which is to be limited only by the scope of the accompanying claims.

What is claimed is:

1. An apparatus for towing a water sports performer, the apparatus comprising:

a first mounting plate adapted for attachment to a port gunwale of a boat;

a second mounting plate adapted for attachment to a starboard gunwale of the boat; and a tower pivotably and detachably secured to the first and second mounting plates, the tower including a tow-line attachment structure at an upper portion thereof, wherein each of the first and second mounting plates includes a retractable tower connector that, when retracted, is positioned at or below a substantially flat upper surface of the mounting plate, and, when not retracted, extends above the upper surface of the mounting plate to pivotably and detachably secure the tower to the mounting plate, each tower connector being retractable with the tower detached by rotating the tower connector about an axis that is non-perpendicular to the substantially flat upper surface of its respective mounting plate.

2. The apparatus of claim 1, wherein each tower connector is retracted by rotating the tower connector about an axis that is substantially parallel to the substantially flat upper surface of its respective mounting plate.

3. The apparatus of claim 1, wherein each tower connector includes a hook that is engageable with the tower.

4. The apparatus of claim 3, wherein, when each tower connector is retracted, a side of the hook is substantially flush with the upper surface of the mounting plate.

5. The apparatus of claim 3, wherein each tower connector further includes a latch for keeping the tower engaged with the hook.

6. The apparatus of claim 5, wherein the tower connector further includes a spring and the latch is movable against a bias imparted by the spring in order to detach the tower from the hook.

7. The apparatus of claim 1, wherein each tower connector includes a pin that is engageable with the tower.

8. The apparatus of claim 1, further comprising a first locking mechanism and a second locking mechanism, the first locking mechanism locking the tower to the first mounting plate and the second locking mechanism locking the tower to the second mounting plate.

9. The apparatus of claim 8, wherein each of the first and second locking mechanisms comprises a bolt that is insertable through a foot of the tower and is engageable with a threaded recess in a respective one of the first and second mounting plates.

10. An apparatus for towing a water sports performer, the apparatus comprising:

a first mounting plate adapted for attachment to a port gunwale of a boat;

a second mounting plate adapted for attachment to a starboard gunwale of the boat;

a tower pivotably and detachably secured to the first and second mounting plates, the tower including a tow-line attachment structure at an upper portion thereof, wherein each of the first and second mounting plates includes a retractable hook-and-latch assembly that, when retracted, is positioned at or below a substantially flat upper surface of the mounting plate, and, when not retracted, extends above the upper surface of the mounting plate to pivotably and detachably secure the tower to the mounting plate, the hook-and-latch assembly being retracted by detaching the tower, by rotating the hook-and-latch assembly about an axis that is substantially perpendicular to an axis about which the tower is pivotable, and without rotating the hook-and-latch assembly about an axis that is substantially perpendicular to the substantially flat upper surface of its respective mounting plate.

11. The apparatus of claim 10, wherein, when each hook-and-latch assembly is retracted, a side of the hook-and-latch assembly is substantially flush with the upper surface of the mounting plate.

12. The apparatus of claim 11, wherein each hook-and-latch assembly includes a hook and a latch for keeping the tower engaged with the hook.

13. The apparatus of claim 12, wherein the latch is movable against a spring bias in order to detach the tower from the hook-and-latch assembly.

14. The apparatus of claim 13, further comprising a first locking mechanism and a second locking mechanism, the first locking mechanism locking the tower to the first mounting plate and the second locking mechanism locking the tower to the second mounting plate.

15. The apparatus of claim 14, wherein each of the first and second locking mechanisms comprises a bolt that is insertable through a foot of the tower and is engageable with a threaded recess in a respective one of the first and second mounting plates.

16. A boat for towing a water sports performer, the boat comprising:

a hull having a bow, a stern, and port and starboard sides, each of the port and starboard sides having a gunwale; and an apparatus for towing a water sports performer, the apparatus including:

a first mounting plate attached to the port gunwale;

a second mounting plate attached to the starboard gunwale; and a tower pivotably and detachably secured to the first and second mounting plates, the tower including a tow-line attachment structure at an upper portion thereof, wherein each of the first and second mounting plates includes a retractable tower connector that, when retracted, is positioned at or below a substantially flat upper surface of the mounting plate, and, when not retracted, extends above the upper surface of the mounting plate to pivotably and detachably secure the tower to the mounting plate, each tower connector being retractable with the tower detached by rotating the tower connector about an axis that is non-perpendicular to the substantially flat upper surface of its respective mounting plate.

17. The boat of claim 16, wherein each tower connector can be retracted by rotating the tower connector about an axis that is substantially parallel to the substantially flat upper surface of its respective mounting plate.

18. The boat of claim 16, further comprising a ski pylon.

19. The boat of claim 16, wherein the tower is pivotable toward the stern of the boat.

20. The boat of claim 16, wherein, when the tower connectors are retracted, the first and second mounting plates protrude no more than about 1 inch above the starboard and port gunwales, respectively.

* * * * *